United States Patent [19]

Onai

[11] Patent Number: 4,889,963

[45] Date of Patent: Dec. 26, 1989

[54] FLEXIBLE ELECTRICALLY CONDUCTIVE SHEET

[75] Inventor: Kozo Onai, Ashikaga, Japan

[73] Assignee: Tokyo Sen-I Kogyo Co., Ltd., Tokyo, Japan

[21] Appl. No.: 271,410

[22] Filed: Nov. 14, 1988

Related U.S. Application Data

[63] Continuation of Ser. No. 150,305, Jan. 29, 1988, abandoned.

[30] Foreign Application Priority Data

Jan. 29, 1987 [JP] Japan ..... 62-012024

[51] Int. Cl.[4] ..... H01B 5/08

[52] U.S. Cl. ..... 174/129 R; 139/425 R; 428/242; 428/244; 428/343

[58] Field of Search ..... 174/117 A, 117 M, 126 R, 174/129 R; 139/425 R; 428/343, 242, 244, 257; 361/212, 220

[56] References Cited

U.S. PATENT DOCUMENTS

| | | | |
|---|---|---|---|
| 1,012,030 | 12/1911 | Underwood | 174/117 M |
| 1,455,744 | 5/1923 | Diamond | 174/117 A |
| 3,288,175 | 11/1966 | Valko | 139/425 R |
| 3,475,213 | 10/1969 | Stow | 174/117 A |
| 3,586,597 | 6/1971 | Okuhashi | 139/475 R |
| 3,762,946 | 10/1973 | Stow et al. | 174/117 A |
| 3,832,598 | 8/1974 | Oehmke et al. | 174/117 A X |
| 3,851,456 | 12/1974 | Hamada et al. | 139/425 R |
| 4,296,855 | 10/1981 | Blalock | 428/244 X |
| 4,307,144 | 12/1981 | Sanders et al. | 428/244 X |
| 4,307,145 | 12/1981 | Goldman | 428/343 X |
| 4,369,622 | 1/1983 | Teed et al. | 57/315 |
| 4,435,465 | 3/1984 | Ebneth et al. | 428/244 X |
| 4,636,427 | 1/1987 | Ohno et al. | 428/343 |

*Primary Examiner*—Morris H. Nimmo

*Attorney, Agent, or Firm*—Staas & Halsey

[57] ABSTRACT

A flexible electrically conductive sheet includes a wove fabric of fibers including stainless steel fibers, the woven fabric being impregnated with a synthetic resin material. Portions of the stainless steel fibers are exposed on surfaces of the synthetic resin material. By bringing an electrostatically charged object into contact with the exposed stainless steel fibers, the charged static electricity can be removed.

10 Claims, 1 Drawing Sheet

FLEXIBLE ELECTRICALLY CONDUCTIVE SHEET

This is a continuation of copending application Ser. No. 150,305 filed on Jan. 29, 1988 now abandoned.

BACKGROUND OF THE INVENTION

The present invention relates to a flexible electrically conductive sheet for being interposed between two objects to pass a weak current such as an electrostatic current for keeping the objects at the same electric potential.

Synthetic fibers and plastic films produce static electricity when they are rubbed against each other or something else under a dry condition. The polarity of the generated static electricity may be positive or negative dependent on the type of the synthetic fibers and plastic films. The voltage of the generated static electricity is proportional to the electric insulation capability of the synthetic fibers and plastic films, and may range from several thousands to several tens of thousand volts.

In the textile industry, the static electricity causes synthetic fibers to be repelled from each other while the fibers are being spun or woven, or causes synthetic fibers to be attracted to machinery, resulting in an operation failure. When manufacturing plastic films, static electricity developed in plastic films is discharged to cause operation problems. Moreover, electronic devices comprising microcomputers or the like, such as office automation devices, placed on an insulative floor made up of wood in a dry room are electrostatically charged during usage, and charged static electricity causes the electronic devices to malfunction or erroneous data to be input or output.

Various efforts have been made to prevent troubles due to electrostatic charging. For example, an atomizer is disposed in a spinning or weaving factory or a plastic film factory to keep the humidity in the factory at 75% or higher at all times. While fibers or plastic films are much less electrostatically charged by the controlled humidity in the factory, it is impossible to completely remove electrostatic charging.

Another proposal is a corona-discharge electrostatic charge remover in which a remover electrode and an installed electrode are provided as means for removing static electricity. A corona discharge is generated between the electrodes to produce ions which are applied to a charged body to neutralize the static electricity, and unnecessary ions are attracted to the installed electrode. However, the corona-discharge electrostatic charge remover is large and complex, and hence highly costly.

According to a further attempt, a rubber sheet with an electrically conductive filler such as carbon black being mixed therein is attached to the circumferential surface of a metallic roller. The energy of static electricity generated can be consumed by the internal resistance of the rubber sheet. As an alternative, electrostaticaly charged objects are brought into contact with a belt made of such electrically conductive rubber to discharge the electrostatic energy. If the rubber sheet is to be of a low resistance, a large amount of filler must be mixed, thus making the rubber sheet brittle and less durable. If the amount of mixed filler is reduced to render the rubber sheet less brittle, no sufficient resistance is obtained, and generated static electricity cannot fully be removed.

SUMMARY OF THE INVENTION

It is an object of the present invention to provide a flexible electrically conductive sheet capable of completely discharging static electricity developed in an object.

Another object of the present invention is to provide a flexible electrically conductive sheet which is highly durable.

Still another object of the present invention is to provide a flexible electrically conductive sheet which can easily be grounded or attached to an object that is not to be electrostatically charged.

According to the present invention, there is provided a flexible electrically conductive sheet comprising an electrically conductive fabric woven of stainless steel fibers and electrically nonconductive fibers, and a flexible synthetic resin material impregnated in the fabric, the stainless steel fibers having portions exposed on surfaces of the synthetic resin material.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
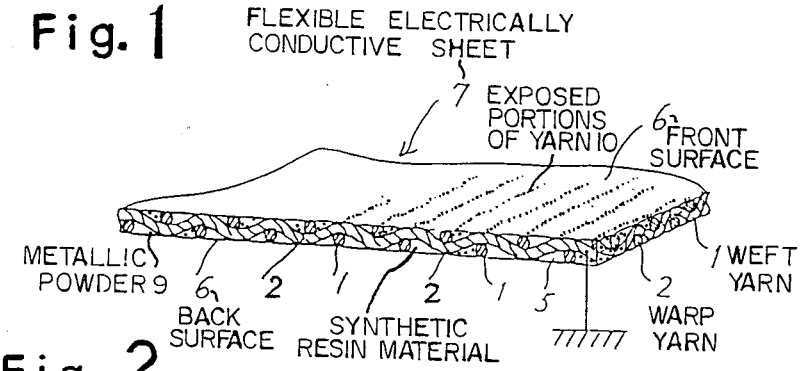
FIG. 1 is a fragmentary perspective view of a flexible electrically conductive sheet according to an embodiment of the present invention.
Figure 2:
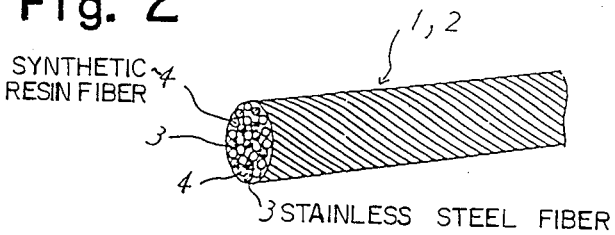
FIG. 2 is an enlarged fragmentary perspective view of warp and weft yarns of the flexible electrically conductive sheet.

As shown in FIGS. 1 and 2, each of weft and warp yarns 1, 2, respectively, is made of stainless steel fibers 3 and synthetic resin fibers 4, each of the fibers 3, 4 having a diameter in the range of from 6 to 20 micrometers. The weft and warp yarns 1, 2 are woven into a fabric by way of a plain weave like gauze.

Since the stainless steel fibers 3 are mixed in the weft and warp yarns 1, 2, the weft and warp yarns 1, 2 are electrically conductive. The fabric woven of these weft and warp yarns 1, 2 has an electric resistance which is suitable for passing and discharging an electrostatic current therethrough.

A synthetic resin material 5 such as a flexible or soft plastic material, e.g., vinyl, is impregnated in the interstices of the woven fabric. The weft and warp yarns 1, 2 of the woven fabric, which is thus impregnated with the synthetic resin material 5, have portions 10 exposed on front and back surfaces 6 thereof. The stainless steel fibers 3 have fiber ends projecting on the exposed warp and weft yarn portions.

In use, the woven fabric impregnated with the synthetic resin material 5, which serves as a flexible electrically conductive sheet 7, is grounded as shown in FIG. 1. When an electrostatically charged object is brought into contact with the flexible electrically conductive sheet 7, the charged static electricity is discharged through the projecting fiber ends of the stainless steel fibers 3 on the surface of the synthetic resin material 5 impregnated in the woven fabric and also through the weft yarns 1 or the warp yarns 2 to ground. Since each of the weft and warp yarns 1, 2 includes thin stainless steel fibers intertwined therein and has a suitable electric resistance, the energy of the static electricity is consumed by the electric resistance without generating any sparks.

In the above embodiment, the electrically nonconductive synthetic resin material 5 is employed as the flexible material. However, metallic powder 9 such as silver powder or zinc powder or carbon black may be mixed in the synthetic resin material to make the latter also electrically conductive.

Figure 3:
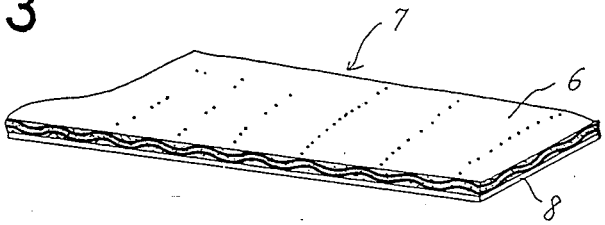
FIGS. 3 and 4 are fragmentary perspective views of flexible electrically conductive sheets according to other embodiments of the present invention.
Figure 4:
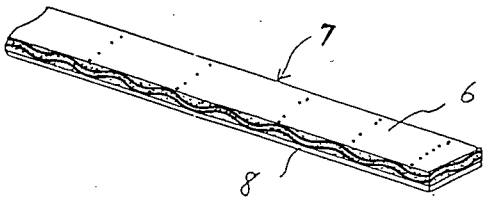

FIGS. 3 and 4 illustrate other embodiments of the present invention. In the embodiment of FIG. 3, an adhesive 8 is coated on one surface of a flexible electrically conductive sheet 7 having a structure as described above. According to the embodiment of FIG. 4, an adhesive 8 is coated on one surface of a narrow strip or tape in the form of a flexible electrically conductive sheet 7.

The flexible electrically conductive sheet 7 of each of the embodiments of FIGS. 3 and 4 is applied to a surface of a piece of wood, a working table of synthetic resin, or a roller of synthetic resin to make the surface electrically conductive. In use, an electrostatically charged object is brought into contact with the flexible electrically conductive sheet 7 to remove the static electricity from the object.

The adhesive coating 8 in FIGS. 3 and 4 may be replaced with an adhesive tape having a peelable piece of paper.

With the present invention, since the woven fabric including stainless steel fibers of the flexible electrically conductive sheet has exposed portions, the static electricity of a charged object brought into contact with the exposed portions of the woven fabric is drained by being grounded through the stainless steel fibers, and hence the charge can easily be removed from the object. The static electricity is discharged without any sparks as the stainless steel fibers are electrically resistive. The flexible electrically conductive sheet has exposed fibers of its woven fabric and hence is highly durable and capable of removing electrostatic charges.

The flexible electrically conductive sheet, in the form of a narrow tape or coated with an adhesive on one surface thereof, can easily be grounded or attached to an object which is not to be electrostatically charged, without requiring large and complex devices or materials.

Although certain preferred embodiments have been shown and described, it should be understood that many changes and modifications may be made therein without departing from the scope of the appended claims.

What I claim is:

1. A flexible electrically conductive sheet comprising:

a plurality of yarns, each made of electrically conductive stainless steel fibers and electrically non-conductive fibers, said yarns being woven as warp and weft yarns to form an electrically conductive fabric;

a flexible synthetic resin material impregnated in said fabric; and said stainless steel fibers having portions exposed on a surface of said synthetic resin material.

2. A flexible electrically conductive sheet according to claim 1, wherein each of said stainless steel fibers has a diameter ranging from 6 to 20 micrometers.

3. A flexible electrically conductive sheet according to claim 1, wherein said stainless steel fibers have fiber ends projecting from said surface of said synthetic resin material.

4. A flexible electrically conductive sheet according to claim 1, wherein an electrically conductive material is mixed with said synthetic resin material.

5. A flexible electrically conductive sheet according to claim 4, wherein said mixed electrically conductive material is metallic powder.

6. A flexible electrically conductive sheet according to claim 4, wherein said mixed electrically conductive material is carbon black.

7. A flexible electrically conductive sheet according to claim 1, further comprising an adhesive coated on one surface of the flexible electrically conductive sheet.

8. A flexible electrically conductive sheet according to claim 1, wherein said flexible electrically conductive sheet is in the form of a tape.

9. A flexible electrically conductive sheet according to claim 8, further comprising an adhesive member mounted on one surface of the flexible electrically conductive tape.

10. A flexible electrically conductive sheet according to claim 9, wherein said adhesive member comprises an adhesive tape.

* * * * *